US009039848B2

(12) United States Patent
Norman et al.

(10) Patent No.: US 9,039,848 B2
(45) Date of Patent: May 26, 2015

(54) AL—MG—ZN WROUGHT ALLOY PRODUCT AND METHOD OF ITS MANUFACTURE

(75) Inventors: Andrew Norman, Beverwijk (NL); Alastair Wise, Santpoort-noord (NL); Achim Burger, Hohr Grenzhausen (DE); Sabine Spangel, Koblenz (DE)

(73) Assignee: ALERIS ALUMINUM KOBLENZ GMBH, Koblenz (DE)

( * ) Notice: Subject to any disclaimer, the term of this patent is extended or adjusted under 35 U.S.C. 154(b) by 830 days.

(21) Appl. No.: 12/742,433

(22) PCT Filed: Nov. 5, 2008

(86) PCT No.: PCT/EP2008/064965

§ 371 (c)(1),
(2), (4) Date: Sep. 1, 2010

(87) PCT Pub. No.: WO2009/062866

PCT Pub. Date: May 22, 2009

(65) Prior Publication Data

US 2010/0319817 A1 Dec. 23, 2010

Related U.S. Application Data

(60) Provisional application No. 60/988,656, filed on Nov. 16, 2007.

(30) Foreign Application Priority Data

Nov. 15, 2007 (EP) ..... 07022205

(51) Int. Cl.

| | |
|---|---|
| ***C22F 1/047*** | (2006.01) |
| ***C22C 21/06*** | (2006.01) |
| ***C22C 21/10*** | (2006.01) |
| ***C22F 1/053*** | (2006.01) |

(52) U.S. Cl.
CPC ..... *C22C 21/06* (2013.01); *C22C 21/10* (2013.01); *C22F 1/047* (2013.01); *C22F 1/053* (2013.01)

(58) Field of Classification Search
USPC ..... 148/690, 692, 693, 697
IPC ..... C22F 1/047
See application file for complete search history.

(56) References Cited

U.S. PATENT DOCUMENTS

| | | | | |
|---|---|---|---|---|
| 2,985,530 | A | 5/1961 | Fetzer et al. | |
| 4,284,437 | A * | 8/1981 | Baba et al. | 148/692 |
| 4,626,294 | A | 12/1986 | Sanders, Jr. | |
| 4,838,958 | A | 6/1989 | Komatsubara et al. | |
| 5,624,632 | A | 4/1997 | Baumann et al. | |
| 6,139,653 | A * | 10/2000 | Fernandes et al. | 148/439 |
| 6,238,495 | B1 | 5/2001 | Haszler et al. | |
| 6,315,948 | B1 | 11/2001 | Lenczowski et al. | |
| 6,337,147 | B1 | 1/2002 | Haszler et al. | |
| 6,695,935 | B1 | 2/2004 | Haszler et al. | |
| 2003/0226623 | A1 * | 12/2003 | Haszler et al. | 148/552 |

FOREIGN PATENT DOCUMENTS

| | | | |
|---|---|---|---|
| EP | 0 259 700 | A1 | 3/1988 |
| JP | 1-225740 | A | 9/1989 |
| JP | 7-278715 | A | 10/1995 |
| JP | 10-121178 | A | 5/1998 |
| JP | 10-310836 | A | 11/1998 |
| WO | 99/42627 | A1 | 8/1999 |
| WO | 00/54967 | A1 | 9/2000 |
| WO | 00/66800 | A1 | 11/2000 |
| WO | 02/063059 | A1 | 8/2002 |

* cited by examiner

*Primary Examiner* — Roy King
*Assistant Examiner* — Janelle Morillo
(74) *Attorney, Agent, or Firm* — Novak Druce Connolly Bove + Quigg LLP

(57) ABSTRACT

An aluminum alloy wrought product including, in wt. %, Mg 3.0 to 7.0, Zn 0.6 to 2.8, Mn 0 to 1.0, Cu 0 to 2.0, Sc 0 to 0.6, at least one element selected from the group of Zr 0.04 to 0.4, Cr 0.04 to 0.4, Hf 0.04 to 0.4 and Ti 0.01 to 0.3; Fe maximum 0.3, Si maximum 0.3, inevitable impurities, and balance aluminum. The range for the Zn-content in wt. % is a function of the Mg-content according to: lower-limit of the Zn-range: [Zn]=0.34[Mg]−0.4, and upper-limit of the Zn-range: [Zn]= 0.34[Mg]+0.4.

33 Claims, No Drawings

AL—MG—ZN WROUGHT ALLOY PRODUCT AND METHOD OF ITS MANUFACTURE

CROSS-REFERENCE TO RELATED APPLICATIONS

This application is a §371 National Stage Application of International Application No. PCT/EP2008/064965, filed on 5 Nov. 2008, claiming the priority of U.S. Provisional Application No. 60/988,656 filed 16 Nov. 2007 and European Patent Application No. 07022205.4 filed 15 Nov. 2007.

FIELD OF THE INVENTION

The invention relates to an aluminium alloy, in particular an Al—Mg—Zn type alloy product for structural members, the alloy product combining a high strength with improved corrosion resistance. Products made from this aluminium alloy product are very suitable for aerospace applications, but not limited to that. The alloy can be processed to various product forms, e.g. sheet, thin plate, thick plate, extruded or forged products. Further, the invention relates to a method of manufacturing such Al—Mg—Zn products.

BACKGROUND TO THE INVENTION

As will be appreciated herein below, except as otherwise indicated, alloy designations and temper designations refer to the Aluminum Association designations in Aluminum Standards and Data and the Registration Records, as published by the Aluminum Association in 2007.

For any description of alloy compositions or preferred alloy compositions, all references to percentages are by weight percent unless otherwise indicated.

There are several high-strength Al—Mg alloys known in the art. For example U.S. Pat. No. 6,315,948-B1 (issued Nov. 13, 2001) discloses an aluminium alloy consisting essentially of, in wt. %, 5-6% Mg, 0.05-0.15% Zr, 0.7-1.0% Mn, 0.01-0.2% Ti, 0.05-0.5% of at least one element selected from the group consisting of Sc and the lanthanide series, wherein at least Sc and 0.005 to 0.5% cerium are present, the balance being aluminium, and unavoidable contaminants not exceeding 0.2% Si. The alloy is reported in particular to be suited for use as body panels of automotive vehicles.

U.S. Pat. No. 5,624,632 (issued Apr. 29, 1997) discloses an aluminium alloy product for use as a damage tolerant product for aerospace applications, the aluminium alloy is substantially zinc-free and lithium-free, and includes 3-7% Mg, 0.05-0.2% Zr, 0.2-1.2% Mn, up to 0.15% Si, and 0.05-0.5% of a dispersoid-forming element selected from the group consisting of: scandium, erbium, yttrium, gadolinium, holmium and hafnium, the balance being aluminium and incidental elements and impurities.

Although, Al—Mg based alloys are thus somewhat suitable for aerospace applications, a need still remains for aluminium alloys that are even stronger than presently available alloys while combining this with a very good corrosion resistance.

DESCRIPTION OF THE INVENTION

It is an object of the invention to an aluminium-magnesium alloy having increased strength. It is another object of the present invention to provide a method of manufacturing such an aluminium alloy product.

These and other objects and further advantages are met or exceeded by the present invention in which there is provided an aluminium alloy wrought product comprising, in wt. %, Mg about 3.0 to 7.0, Zn about 0.6 to 2.8, Mn 0 to about 1.0, Cu 0 to about 2.0, Sc 0 to about 0.6, at least one element selected from the group consisting of: (Zr about 0.04 to 0.4, Cr about 0.04 to 0.4, Hf about 0.04 to 0.4, Ti about 0.01 to 0.3), Fe maximum about 0.3, Si maximum about 0.3, inevitable impurities, and balance aluminium, and whereby the range for the Zn-content is a function of the Mg-content according to:

lower-limit of the Zn-range: $[Zn]=0.34[Mg]-0.4$, and upper-limit of the Zn-range: $[Zn]=0.34[Mg]+0.4$.

The alloy product according to the invention provides an at least 20% increase in strength over other 5000-series alloys, such as AA5053, when compared for alloy having the same Mg content. This increase in strength is combined with an excellent corrosion resistance, even in the sensitised condition.

The significance of each element in the alloy product according to the invention is as follows.

The Mg is the main alloying element in the alloy according to the invention and provides the main strength to the alloy product. In a preferred embodiment the lower-limit for the Mg-content is about 4.0%, and more preferably about 4.2%. A preferred upper-limit for Mg content is about 5.0%, and more preferably about 4.9. %. A too high Mg content makes the alloy product susceptible to edge cracking and alligatoring during a hot working operation, in particular when rolling. A too low Mg content does not provide sufficient strength to the alloy product.

The other main alloying element in the product according to this invention of zinc. The addition of Zn is carefully controlled within the defined limits to avoid the formation of substantial amounts of a β-phase which could otherwise form in the alloy. By keeping the volume fraction of β-phase very low, it is no longer possible to produce a continuous network of precipitates along the grain boundaries thus producing an alloy product which is highly resistant to IGC behaviour, even in a sensitised condition. The exact amount of Zn that is required is linked to the Mg level of the alloy, such that as the Mg level in the alloy is increased, also the required level of Zn is increased. Furthermore, the addition of Zn allows for the formation of precipitates of Mg—Zn phases to form during thermal treatments, in particular during the heat treatment after the cold working operations, leading to a significant improvement in the strength of the alloy product, while benefiting from the increased corrosion resistance.

In an embodiment of the alloy product Mn in a range of about 0.1 to 1.0, preferably about 0.6 to 1.0%, is added to the alloy product as a dispersoid forming element to control grain structure during thermo-mechanical processing and thereby increasing the strength of the alloy product.

In another embodiment of the alloy product the Mn is present as an impurity element which can be tolerated to a level of at most 0.1%, and preferably at most about 0.05%, e.g. at about 0.02% or less. Thus the alloy may be substantially free from Mn. In the embodiment where Mn is present at an impurity level at least one of the elements selected from the group of Zr, Cr, Hf, or Ti must be added. In this embodiment it has been found that very high strength levels can be achieved, whereas in the prior art in AlMg alloys the addition of Mn is considered to be required to achieve a sufficient strength level. For this invention, ideally at least Zr is added. And in a more preferred embodiment at least both Zr and Sc are added. In accordance with the invention it has been found that in the embodiment where Mn is present as impurity level that an increase in damage tolerance properties of the alloy product can be achieved.

In an embodiment of the alloy product Cu is added in a range of about 0.1% to 1.5%, and preferably in a range of about 0.2% to 1.2%, to further increase the alloy strength, although at the trade off of some corrosion resistance. This balance of increased strength and slightly reduced corrosion resistance renders the alloy product according to the invention suitable in particular for various armour plate, tooling and moulding plate applications.

In another embodiment of the alloy product the Cu is present as an impurity element, in particular for application where corrosion forms a critical engineering parameter, which can be tolerated to a level of at most 0.1%, and preferably at most about 0.05%, e.g. at about 0.02% or less. Thus the alloy may be substantially free from Cu.

Scandium can be added to the alloy product in a range of about 0.05% to 0.6%, and preferably in a range of 0.07% to 0.25%. The addition of Sc results in the formation of $Al_3Sc$ dispersoids which inhibit recrystallisation during theremomechanical processing, thereby imparting greater strength. In particular when annealed at temperatures below 350° C. precipitates in a range of about 1 to 10 nm are formed, and which are believed to increase the strength of the allow product.

To the alloy product according to the invention at least one or more elements are added selected from the group consisting of:

| | |
|---|---|
| Zr | about 0.04 to 0.4%, preferably about 0.06 to 0.15% |
| Cr | about 0.04 to 0.4%, preferably about 0.06 to 0.15% |
| Hf | about 0.04 to 0.4%, preferably about 0.06 to 0.15% |
| Ti | about 0.01 to 0.3%, preferably about 0.02 to 0.15.% |

In a preferred mode Zr is added in the defined ranges, in particular when there is also a purposive addition of Sc. Zirconium acts to stabilise the $Al_3Sc$ dispersoids so that they can maintain the alloys strength, even at high temperatures during processing of the alloy product or during the lifetime of a component made from the alloy product, e.g. de-icing tubes for the leading edge of the wing of an aircraft. Hf can be used either in place of or with Zr.

The Si content in the alloy product should be less than 0.3%, and can be present as a purposive alloying element. In another embodiment silicon is present as an impurity element and should be present at the lower-end of this range, e.g. less than about 0.15%, and more preferably less than 0.1%, to maintain fracture toughness properties at desired levels, in particular when used for aerospace application.

The Fe content in the alloy product should be less than 0.3%. When the alloy product is used for aerospace application the lower-end of this range is preferred, e.g. less than about 0.15%, and more preferably less than about 0.07% to maintain in particular the toughness at a sufficiently high level. Where the alloy product is used for commercial applications, such as tooling plate, a higher Fe content can be tolerated.

The alloy product can contain normal and/or inevitable elements and impurities, typically each <0.05% and the total <0.2%, and the balance is made by aluminium.

For this invention it should be understood that the alloy product has no Li present other than as an unavoidable impurity element, and which can be tolerated to a level of at most 0.05%, e.g. at about 0.02% or less. Thus the alloy is substantially free from Li.

For the purpose of this invention with "substantially free" and "essentially free" we mean that no purposeful addition of this alloying element was made to the composition, but that due to impurities and/or leaching from contact with manufacturing equipment, trace quantities of this element may, nevertheless, find their way into the final alloy product.

In a preferred embodiment of the invention, the alloy has a composition consisting of, in wt. %:

| | |
|---|---|
| Mg | 4.0 to 5.0, preferably 4.2 to 4.9 |
| Zn | 0.96 to 2.1 |
| Mn | <0.1, preferably <0.05 |
| Cu | 0 to 2.0 |
| Sc | 0.05 to 0.6, preferably 0.07 to 0.25 |
| Zr | 0.04 to 0.4, preferably 0.06 to 0.15 |

optionally one or more element selected from the group consisting of:

| | |
|---|---|
| Cr | 0.04 to 0.4 |
| Hf | 0.04 to 0.4 |
| Ti | 0.01 to 0.3, |
| Fe | max. 0.15 |
| Si | max. 0.15, |

balance inevitable impurities each <0.05, total <0.25, balance aluminium, and whereby the range for the Zn-content is a function of the Mg-content according to:

lower-limit of the Zn-range: [Zn]=0.34[Mg]−0.4, and upper-limit of the Zn-range: [Zn]=0.34[Mg]+0.4.

In another preferred embodiment of the invention, the alloy has a composition consisting of, in wt. %:

| | |
|---|---|
| Mg | 4.0 to 5.0, preferably 4.2 to 4.9 |
| Zn | 0.96 to 2.1 |
| Mn | 0.1 to 1.0, preferably 0.7 to 1.0 |
| Cu | 0 to 2.0 |
| Sc | 0.05 to 0.6, preferably 0.07 to 0.25 |
| Zr | 0.04 to 0.4, preferably 0.06 to 0.15 |

optionally one or more element selected from the group consisting of:

| | |
|---|---|
| Cr | 0.04 to 0.4 |
| Hf | 0.04 to 0.4 |
| Ti | 0.01 to 0.3, |
| Fe | max. 0.15 |
| Si | max. 0.15, |

balance inevitable impurities each <0.05, total <0.25, balance aluminium, and whereby the range for the Zn-content is a function of the Mg-content according to:

lower-limit of the Zn-range: [Zn]=0.34[Mg]−0.4, and upper-limit of the Zn-range: [Zn]=0.34[Mg]+0.4.

In the alloy product according to this invention, the best balance in properties is achieved when the alloy product has an unrecrystallised microstructure, meaning that 30% or less, and preferably 15% or less of the grains in a final condition are non-recrystallised. This microstructure is obtained by the process according to this invention.

In another aspect of the invention it provides a method of manufacturing the aluminium alloy product, the method comprising the steps of:

a. casting stock of an ingot of an AlMg alloy having a chemical composition according to the invention,
b. preheating and/or homogenising the cast stock;
c. hot working the stock by one or more methods selected from the group consisting of rolling, extrusion, and forging;
d. annealing of the hot worked stock followed by rapid cooling;
e. cold working the annealed and cooled stock;
f. optionally stretching or compressing of the cold worked stock;
h. heat treating of the stock to achieve a desired temper.

The aluminium alloy can be provided as an ingot or slab or billet for fabrication into a suitable wrought product by casting techniques regular in the art for cast products, e.g. DC-casting, EMC-casting, EMS-casting. Slabs resulting from continuous casting, e.g. belt casters or roll casters, also may be used, which in particular may be advantageous when producing thinner gauge end products. Grain refiners such as those containing titanium and boron, or titanium and carbon, may also be used as is known in the art. After casting the alloy stock, the ingot is commonly scalped to remove segregation zones near the cast surface of the ingot.

Homogenisation treatment is typically carried out in one or multiple steps, each step having a temperature in the range of about 400° C. to 560° C. The pre-heat temperature involves heating the hot working stock to the hot-working entry temperature, which is typically in a temperature range of about 350° C. to 560° C.

Following the preheat and/or homogenisation practice the stock can be hot worked by one or more methods selected from the group consisting of rolling, extrusion, and forging, preferably using regular industry practice. The method of hot rolling is preferred for the present invention.

The hot working, and hot rolling in particular, may be performed to a final gauge, e.g. 3 mm or less or alternatively thick gauge products. Alternatively, the hot working step can be performed to provide stock at intermediate gauge, typical sheet or thin plate.

It is an important aspect of the present invention that in order to arrive at the desired set of engineering properties for the application of the AlMg alloy product, that following the hot working operation the product is subjected to an annealing heat treatment and where after the product is rapidly cooled or quenched, preferably by one of spray quenching or immersion quenching in water or other quenching media. These quenching techniques themselves are known to the skilled person. Whereas in the prior art following the annealing treatment on an industrial scale the 5000-series alloy products are commonly allowed to cool by means of air cooling. Air cooling means that the product is being removed from a furnace and allowed to cool down by maintaining the product on the shop floor to cool, and whereby occasionally a fan is used to create some minor air circulation. In the context of this invention it is desired that the product is rapidly cooled or quenched in order to avoid as much as possible that Mg—Zn phases, such as $MgZn_2$, will precipitate coarsely leading to a less of strength in the final condition.

The annealing treatment is typically carried out at a temperature in a range of 350° C. to 450° C. for the alloy products according to the invention which do not have Sc in an amount exceeding 0.05%. Typical annealing times are in a range of up to about 2 hours.

The annealing treatment is typically carried out at a temperature in a range of about 300° C. to 350° C., preferably about 330° C. to 350° C., for the embodiment according to this invention containing Sc in a range of 0.05% to 0.6%, with preferred narrower ranges. In this embodiment typical annealing times are in a range of up to about 5 hours.

Thereafter, this stock at intermediate gauge can be cold worked, e.g. by means of rolling, to a final gauge. Depending on the alloy composition and the amount of cold work an intermediate anneal may be used during the cold working operation to enhance workability. However, in accordance with the invention it is important that if one or more intermediate annealing treatments are applied during the cold working operation(s), that the product is rapidly cooled from the annealing temperature at least after the last intermediate annealing prior to the last cold working operation.

Optionally, the alloy product after cold working, for example by means of rolling, is being cold stretching in a cold working operation consists of a stretch in a range of about 0.5 to 10%, and preferably in a range of about 0.5 to 6%. The alloy product may also be cold compressed.

After the cold working operation, and after the optional cold stretch or compression operation, the alloy product is heat treated whereby the cold worked microstructure becomes recovered leading to an improved balance of properties. During this heat treatment the alloy product also receives a desired artificial ageing treatment to form fine scale strengthening precipitates of the Mg—Zn-phases, resulting in a significant increase in the strength of the alloy product of at least 60 MPa or more, and in the best results of at least 80 MPa or more.

Typical heat treatments are carried out at a temperature in a range of about 100° C. to 210° C. in one or more heat treatment steps. For example, a first heat treatment could be carried out at a temperature in a range of about 105° C. to 135° C., preferably for at least 30 minutes and more typically from about 2 to 20 hours depending on the temperature. The first heat treatment, or first ageing step, may be followed by a second heat treatment or second ageing step, at a temperature in a range of 135° C. to 210° C., and more typically in a range of 140° C. to 175° C., typically for a time of at least 4 hours and more typically from about 6 to 28 hours. Optionally, this second heat treatment may be followed by a third heat treatment, for example at a temperature of about 105° C. to 145° C., typically for a time up to about 30 hours.

The aluminium alloy product according to the present invention can be used advantageously in structural applications, in particular as armour plate, moulding plate, pressure vessels, or in storage silos, tanker lorries, and for marine applications. When used for a structural member in an aircraft, the alloy product can be used in particular for aircraft rib, aircraft spar, aircraft frame, stringers, pressure bulkheads, fuselage sheet, lower wing panels, thick plate for machined parts or forgings or thin plate for stringers. The alloy products processed according to the invention can also be provided in the form of a stepped extrusion or extruded spar for use in an aircraft structure, or in the form of a forged spar for use in an aircraft wing structure.

The aluminium alloy product according to the invention is very suitable to be joined to a desired product by all conventional joining techniques including, but not limited to, fusion welding, friction stir welding, riveting and adhesive bonding.

In the following, the invention will be explained by the following, non-limitative example.

EXAMPLE

Three aluminium alloys have been cast having a composition as given in Table 1, and wherein alloy A and B are according to this invention and alloy C is an AA5083 alloy forming the baseline alloy. The ingots were machined into various rolling blocks of 80×80×100 mm. The rolling blocks were heat to 450° C. at a rate of 35° C./hour, and soaked at this temperature for 10 hours. The ingots were hot rolled from 80 mm to a gauge of 4 mm, and then followed by two different processing routes.

Route 1:

4 mm sheets were annealed at 475° C. for 30 minutes and air cooled;

Cold rolling to reduce the gauge to 2.4 mm;

After cold rolling, the sheet was annealed at 480° C. for 30 minutes, followed by air cooling;

The sheets were then given a 1.5% stretch.

The material was then tested in this condition.

Route 2:

4 mm sheets were annealed at 475° C. for 30 minutes and then water quenched;

Cold rolling to reduce the gauge to 2.4 mm;

After cold rolling, the sheet was annealed at 250° C. for 30 minutes, followed by air cooling;

The sheets were then given a 1.5% stretch.

The material was then tested in this condition.

The tensile properties of each alloy was measured for the different processing routes using standard Euro norm specimens. The tensile properties are listed in Table 2.

From the results of Table 2 it can be seen for processing Route 1 that Alloy A has an increased Proof Strength of at least 10% compared to the baseline alloy C (AA5083), whereas alloy B has an increase of about 35%.

Whereas for processing Route 2 the Alloy A is about 35% stronger than the baseline line, and ally B is about 50% stronger than the baseline alloy.

The corrosion properties were measured using the weight loss test designed for Al—Mg alloys, according to the standard ASTM G67. Prior to performing the corrosion tests, each sheet was sensitised using a thermal treatment of 120° C. for 10 days. This is a quantitative test and focuses on Intergranular Corrosion behaviour (IGC). According to this standard test, an alloy which exhibits a weight loss of less than 15 mg/cm$^2$ can be considered as IGC resistant, whereas an alloy which has a weight loss in excess of 25 mg/cm$^2$ is considered to have no resistance to IGC. Where a weight loss of between 15-25 mg/cm$^2$ is achieved, the alloy is said to be doubtful with regards to IGC performance. The results are listed in Table 3.

From the results of Table 3 it can be seen that the baseline alloy C has little resistance to IGC when processed via both processing routes. Both Alloys A and B perform significantly better when processed via route 1. Whereas when processed according to route 2, both Alloys A and B show excellent resistance to IGC with a weight loss of 6 and 13 mg/cm$^2$ respectively.

The corrosion performance has been tested also using the test according to ASTM G110, which is commonly used for 2000- and 7000-series alloys. The test measures the exfoliation behaviour and is a visual test. Also for this test prior to performing the corrosion tests, each sheet was sensitised using a thermal treatment of 120° C. for 10 days. It appears that Alloy A processed via route 1 and route 2 showed no noticeable signs of attack. However, for alloy B which contains both addition of Cu and Zn the alloy processed via route 1 shows classical IGC behaviour which one may see also for example in 2024 alloys. Whereas Alloy B when processed according to route 2 showed only evidence of pitting.

TABLE 1

Composition of the alloys, balance Al and regular impurities.

| | Element | | | | | | | | |
|---|---|---|---|---|---|---|---|---|---|
| Alloy | Mg | Mn | Zn | Cu | Fe | Si | Cr | Zr | Ti |
| A | 4.5 | 0.7 | 1.5 | — | 0.03 | 0.03 | — | — | 0.03 |
| B | 4.5 | 0.7 | 1.5 | 1.0 | 0.03 | 0.03 | — | — | 0.03 |
| C | 4.65 | 0.65 | 0.11 | 0.05 | 0.25 | 0.19 | 0.19 | — | 0.03 |

TABLE 2

Tensile properties for the alloys of Table 1.

| Alloy | Process route | 0.2% PS [MPa] | UTS [MPa] | EI [%] |
|---|---|---|---|---|
| A | 1 | 187 | 329 | 33 |
| | 2 | 308 | 334 | 14 |
| B | 1 | 231 | 390 | 30 |
| | 2 | 348 | 412 | 10 |
| C | 1 | 168 | 307 | 18 |
| | 2 | 228 | 317 | 16 |

TABLE 3

Weight loss results for the alloys after sensitisation at 120° C. for 10 days.

| Process route | Alloy | Weight loss (mg/cm$^2$) |
|---|---|---|
| 1 | A | 22 |
| | B | 21 |
| | C | 46 |
| 2 | A | 6 |
| | B | 13 |
| | C | 36 |

The invention claimed is:

1. Method of manufacturing aluminum wrought product comprising the steps of:

a. casting stock of an ingot of an Al—Mg alloy having a chemical composition comprising, in wt. %,

| | |
|---|---|
| Mg | 3.0 to 7.0 |
| Zn | 0.6 to 2.8 |
| Mn | 0 to 1.0 |
| Cu | 0 to 2.0 |
| Sc | 0 to 0.5, |

at least one element selected from the group consisting of:

| | |
|---|---|
| Zr | 0.04 to 0.4 |
| Cr | 0.04 to 0.4 |
| Hf | 0.04 to 0.4 and |
| Ti | 0.01 to 0.3, |
| Fe | max. 0.3 |
| Si | max. 0.3, |

inevitable impurities, balance aluminium, and whereby the range for the Zn-content is a function of the Mg-content according to:

lower-limit of the Zn-range: [Zn]=0.34[Mg]−0.4, and upper-limit of the Zn-range: [Zn]=0.34[Mg]+0.4, and wherein the aluminium alloy product is substantially Li free;

b. preheating and/or homogenising the cast stock;

c. hot working the stock by one or more methods selected from the group consisting of rolling, extrusion, and forging;

d. annealing of the hot worked stock, wherein the annealing treatment is carried out at a temperature in a range of 350° C. to 475° C., followed by rapid cooling;

e. cold working the annealed and cooled stock;

f. stretching the cold worked stock in a range of 0.5 to 10%;

h. heat treating of the stock to achieve a desired temper.

2. Method according to claim 1, wherein during step d.) the heat treatment is carried out for an annealing time of up to 2 hours.

3. Method according to claim 1 during step d.) the heat treatment is carried out for an annealing time up to 5 hours.

4. Method according to claim 1, wherein the product has an unrecrystallised microstructure.

5. Method according to claim 1, wherein the product is a structural member of an aircraft.

6. Method according to claim 1, wherein the product is armour plate.

7. Method according to claim 1, wherein the product is moulding plate.

8. Method according to claim 1, wherein the aluminum alloy product has a Mg-content in a range of 3.0 to 5.0%.

9. Method according to claim 1, wherein the aluminum alloy product has a Mg-content in a range of 4.0 to 5.0%.

10. Method according to claim 1, wherein the aluminum alloy product has a Mg-content in a range of 4.2% to 4.9%.

11. Method according to claim 1, wherein the aluminum alloy product has a Sc addition combined with an addition of Zr in a range of 0.04 to 0.4%.

12. Method according to claim 1, wherein the aluminium alloy product has a Sc addition combined with an addition of Zr in a range of 0.06 to 0.15%.

13. Method according to claim 1, wherein the aluminium alloy has a Cu-content in a range of 0 to 0.1%.

14. Method according to claim 1, wherein the aluminium alloy has a Cu-content in a range of 0 to 0.05%.

15. Method according to claim 1, wherein the aluminium alloy has a Cu-content is in a range of 0.1 to 1.5%.

16. Method according to claim 1, wherein the aluminium alloy has a MnO-content of <0.1%.

17. Method according to claim 1, wherein the aluminium alloy has a MnO-content of <0.05%.

18. Method according to claim 1, wherein the aluminium alloy has a composition consisting of, in wt. %:

| | |
|---|---|
| Mg | 4.0 to 5.0 |
| Zn | 0.96 to 2.1 |
| Mn | <0.1 |
| Cu | 0 to 2.0 |
| Sc | 0 to 0.05 |
| Zr | 0.04 to 0.4 |

optionally one or more element selected from the group consisting of:

| | |
|---|---|
| Cr | 0.04 to 0.4 |
| Hf | 0.04 to 0.4 and |
| Ti | 0.01 to 0.3, |
| Fe | max. 0.15 |
| Si | max. 0.15, |

balance inevitable impurities each <0.05, total <0.25, balance aluminium, and whereby the range for the Zn-content is a function of the Mg-content according to:

lower-limit of the Zn-range: [Zn]=0.34[Mg]−0.4, and upper-limit of the Zn-range: [Zn]=0.34[Mg]+0.4.

19. Method according to claim 1, wherein the aluminium alloy product has a composition consisting of, in wt. %:

| | |
|---|---|
| Mg | 4.0 to 5.0 |
| Zn | 0.96 to 2.1 |
| Mn | 0.1 to 1.0 |
| Cu | 0 to 2.0 |
| Sc | 0.05 to 0.05 |
| Zr | 0.04 to 0.4 |

optionally one or more element selected from the group consisting of:

| | |
|---|---|
| Cr | 0.04 to 0.4 |
| Hf | 0.04 to 0.4 and |
| Ti | 0.01 to 0.3, |
| Fe | max. 0.15 |
| Si | max. 0.15, |

balance inevitable impurities each <0.05, total <0.25, balance aluminium, and whereby the range for the Zn-content is a function of the Mg-content according to:

lower-limit of the Zn-range: [Zn]=0.34[Mg]−0.4, and upper-limit of the Zn-range: [Zn]=0.34[Mg]+0.4.

20. Method according to claim 1, wherein the annealing of step d.) forms $Al_3Sc$ dispersoids.

21. Method according to claim 20, wherein Zr is present and the Zr stabilizes the $Al_3Sc$ dispersoids.

22. Method according to claim 1, wherein the aluminium alloy has a composition consisting of, in wt. %:

| | |
|---|---|
| Mg | 3.0 to 7.0 |
| Zn | 0.6 to 2.8 |
| Mn | 0 to 0.1 |
| Cu | 0 to 2.0 |

at least one element selected from the group consisting of:

| | |
|---|---|
| Zr | 0.04 to 0.4 |
| Cr | 0.04 to 0.4 |
| Hf | 0.04 to 0.4 and |
| Ti | 0.01 to 0.3, |
| Fe | max. 0.3 |
| Si | max. 0.3, |

inevitable impurities, balance aluminium, and whereby the range for the Zn-content is a function of the Mg-content according to:

lower-limit of the Zn-range: [Zn]=0.34[Mg]−0.4, and upper-limit of the Zn-range: [Zn]=0.34[Mg]+0.4.

23. Method according to claim 1, wherein 30% or less of grains of the alloy in final condition are non-recrystallized.

24. Method according to claim 1, wherein 15% or less of grains of the alloy in final condition are non-recrystallized.

25. Method according to claim 1, wherein the heat treating of the stock to achieve the desired temper comprises a heat treatment carried out at a temperature in a range of about 100° C. to 210° C. in one or more heat treatment steps.

26. Method according to claim 25, wherein the heat treating of the stock to achieve the desired temper comprises a first heat treatment carried out at a temperature in a range of about 105° C. to 135° C., for at least 30 minutes.

27. Method according to claim 26, wherein the heat treating of the stock to achieve the desired temper further comprises a second heat treatment following the first heat treatment, the second heat treatment carried out at a temperature in a range of 135° C. to 210° C. for at least 4 hours.

28. Method according to claim 1, wherein the heat treating of the stock to achieve the desired temper further comprises a third heat treatment following the second heat treatment, the third heat treatment at a temperature of about 105° C. to 145° C. for up to about 30 hours.

29. Method according to claim 1, wherein the rapid cooling is performed by one of spray quenching or immersion quenching in water.

30. Method according to claim 1, wherein the cold working comprises two or more sequential cold working operations, further comprising applying one or more intermediate annealing treatments to the stock between said cold working operations, wherein the intermediate annealed stock is rapidly cooled from the intermediate annealing temperature at least after the intermediate annealing prior to the last cold working operation.

31. Method according to claim 30, wherein the cold working comprises cold rolling the stock and stretching the stock, wherein the cold rolled stock is stretched 0.5 to 10%, wherein following the cold rolling the cold rolled stock is intermediate annealed, and then the intermediate annealed stock is rapidly cooled from the intermediate annealing temperature, and then the intermediate annealed rapidly cooled stock undergoes said stretching.

32. Method according to claim 22, wherein the cold working comprises cold rolling the stock and stretching the stock, wherein the cold rolled stock is stretched 0.5 to 10%, wherein following the cold rolling the cold rolled stock is intermediate annealed, and then the intermediate annealed stock is rapidly cooled from the intermediate annealing temperature, and then the intermediate annealed rapidly cooled stock undergoes said stretching, wherein the heat treating of the stock to achieve the desired temper comprises a first heat treatment carried out at a temperature in a range of about 105° C. to 135° C., for at least 30 minutes, wherein the heat treating of the stock to achieve the desired temper further comprises a second heat treatment following the first heat treatment, the second heat treatment carried out at a temperature in a range of 135° C. to 210° C. for at least 4 hours.

33. Method according to claim 1, wherein the aluminium alloy Cu-content is in a range of 0.2 to 1.2 wt. %.

* * * * *

UNITED STATES PATENT AND TRADEMARK OFFICE

CERTIFICATE OF CORRECTION

PATENT NO. : 9,039,848 B2
APPLICATION NO. : 12/742433
DATED : May 26, 2015
INVENTOR(S) : Andrew Norman et al.

It is certified that error appears in the above-identified patent and that said Letters Patent is hereby corrected as shown below:

Claims

Claim 1, Column 8, Line 48: "Mn 0 to [[1.0]] 0.1"
Claim 19, Column 10, Line 13: "Mn 0.1 to [[1.0]] 0.1"

Signed and Sealed this
Seventeenth Day of November, 2015

Michelle K. Lee

Michelle K. Lee
*Director of the United States Patent and Trademark Office*